US005487291A

United States Patent [19]

Voigt

[11] Patent Number: 5,487,291

[45] Date of Patent: Jan. 30, 1996

[54] KEY HOLDER CASE WITH EASY ACCESS FEATURE

[76] Inventor: Bernard Voigt, 15 High St., Hicksville, N.Y. 11801

[21] Appl. No.: 247,007

[22] Filed: May 23, 1994

[51] Int. Cl.[6] ..... A47G 29/10

[52] U.S. Cl. ..... 70/456 R; 7/170; 70/408; 206/37.2; 206/37.4; 206/38.1; 362/116

[58] Field of Search ..... 70/456 R, 459, 70/460, 396, 399, 408; 206/37.1, 37.2, 37.3, 37.4, 37.6, 37.8, 38.1, 37.2, 37.4; D3/209; 7/170; 362/116

[56] References Cited

U.S. PATENT DOCUMENTS

| | | | |
|---|---|---|---|
| D. 262,241 | 12/1981 | Meo | D3/209 |
| 1,934,889 | 11/1933 | Segal | 70/456 R |
| 1,972,880 | 9/1934 | Flintermann | 70/456 R |
| 2,208,498 | 7/1940 | Cramer | 70/456 R |
| 2,210,048 | 8/1940 | Swanson | 24/3 K |
| 2,393,373 | 1/1946 | Hendrix | 70/456 R |
| 2,412,056 | 12/1946 | Mosch | 70/456 R |
| 2,485,483 | 10/1949 | Cunningham | 70/456 R X |
| 2,547,816 | 4/1951 | Duncan | 70/456 R X |
| 2,595,981 | 5/1952 | Prickett et al. | 70/456 R |
| 2,615,227 | 10/1952 | Hornik | 70/459 |
| 2,630,212 | 3/1953 | Mosch | 70/456 R X |
| 2,640,347 | 6/1953 | Majeski | 70/456 R |
| 2,652,712 | 9/1953 | Hoag | 70/456 R |
| 3,296,429 | 1/1967 | Schwartz | 70/456 R X |
| 3,377,475 | 4/1968 | Frigon | D3/209 X |
| 3,981,169 | 9/1976 | Youd | 70/456 R |
| 4,161,891 | 7/1979 | Bossert | 292/348 X |
| 4,581,910 | 4/1986 | Brooks et al. | 70/456 R |
| 5,359,870 | 11/1994 | Reutlinger | 70/456 R |

*Primary Examiner*—Lloyd A. Gall
*Attorney, Agent, or Firm*—Michael I. Kroll

[57] ABSTRACT

An improved key holder case with easy access feature is provided, which consists of a housing for carrying at least one key therein. A structure is for easy accessing at least one key from the housing, so that at least one key will extend out from the housing to allow a person to utilize at least one key in a lock.

5 Claims, 4 Drawing Sheets

3
24
88
24
1a
28
90
1a
2
35
26
32
20
22
31
28
2a
20
28
24
92
88
4
31
2
22
34
84
24

20
22
31
32
4A
24
35
4A
36
26
86

31
20
35
26
22
32
20
28
34
22
30
31
88
20
26

35
92
90
32
22
31
36

24
24
34
20
26
24
36

24

20
22
52
70
68
64
54
62
26
58
56
28
24
30
10

52
62
20
26
54
56
28
58
22
64
24

26
30
20
56
64
22
62
52

52
70
22
68
20
52
60
64
13
26
28
62
54
68
13
56
70

62
64
52
52
68
20
22
60
22
70

28
56
26

52
20
22
22
64
68
62
60
70
70
72
60
20
22
74
52
22
52
64

KEY HOLDER CASE WITH EASY ACCESS FEATURE

BACKGROUND OF THE INVENTION

1. Field of the Invention

The instant invention relates generally to key cases and more specifically it relates to an improved key holder case with easy access feature.

3. Description of the Prior Art

Numerous key cases have been provided in prior art that are adapted to hold keys therein, so that the keys can be used at a future time. While these units may be suitable for the particular purpose to which they address, they would not be as suitable for the purposes of the present invention as heretofore described.

SUMMARY OF THE INVENTION

A primary object of the present invention is to provide an improved key holder case with easy access feature that will overcome the shortcomings of the prior art devices.

Another object is to provide an improved key holder case with easy access feature, so that one key at a time can be retrieved therefrom to be used in opening a lock.

An additional object is to provide an improved key holder case with easy access feature that can have a built in illumination device to be used at night and in dimly lit areas, while a clip on the back can be worn on a belt or garment.

A further object is to provide an improved key holder case with easy access feature that is simple and easy to use.

A still further object is to provide an improved key holder case with easy access feature that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a top perspective view of a first embodiment of the instant invention.

FIG. 1*a* is a top cross sectional perspective view taken along line 1*a*—1*a* in FIG. 1.

FIG. 2 is a top cross sectional perspective view taken along line 2—2 in FIG. 1.

FIG. 2*a* is a bottom perspective view of a portion thereof, as indicated by arrow 2*a* in FIG. 1.

DETAILED DESCRIPTION OF THE PREFERRED EMBODIMENTS

Figures 1, 1A, 2, 2A, 3, 4, 4A:
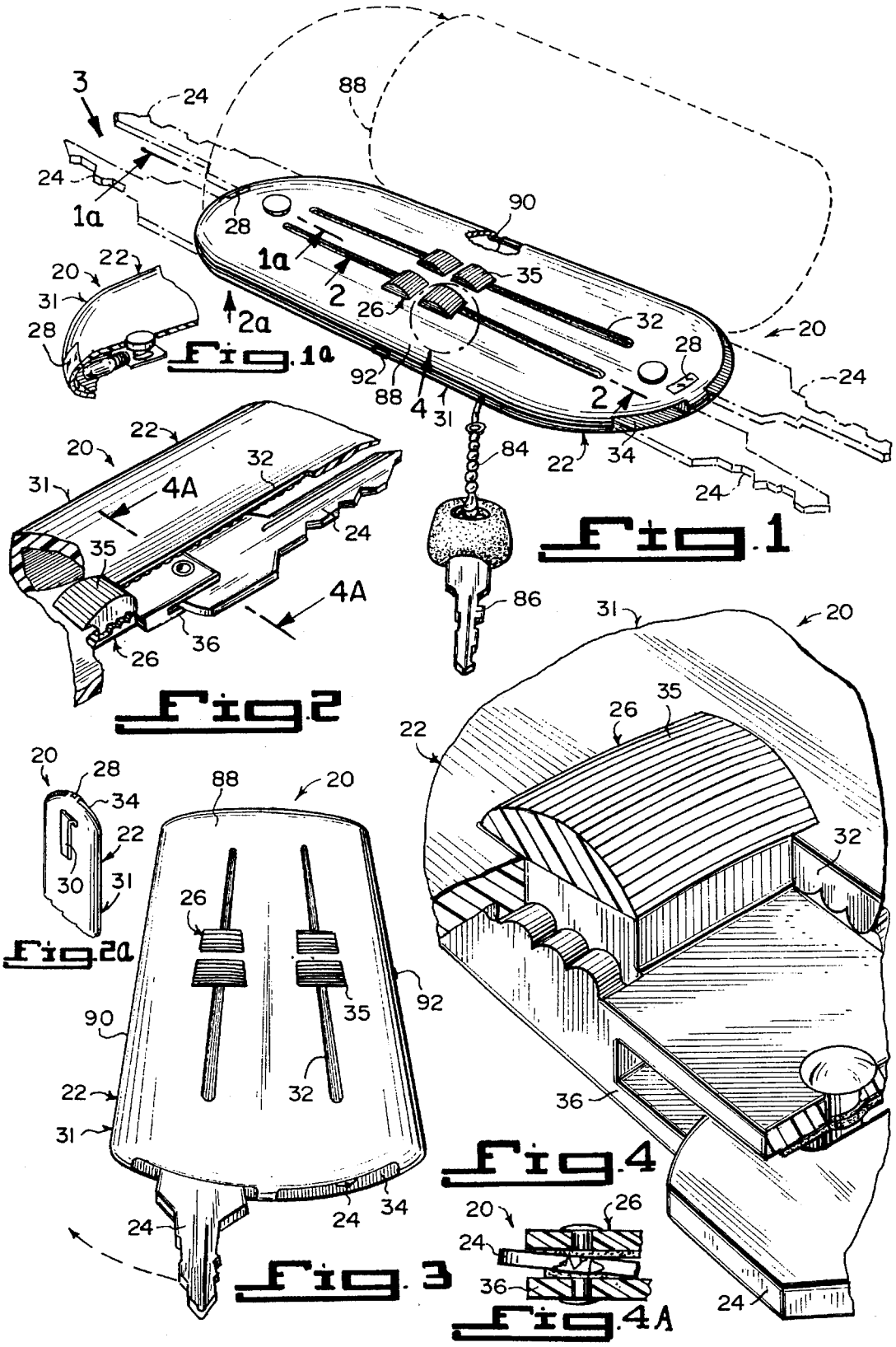
FIG. 3 is a top perspective view as indicated by arrow 3 in FIG. 1.
FIG. 4 is an enlarged top perspective view with parts broken away and in section as indicated by arrow 4 in FIG. 1.
FIG. 4A is a cross sectional view taken along line 4A—4A in FIG. 2.
Figure 5:
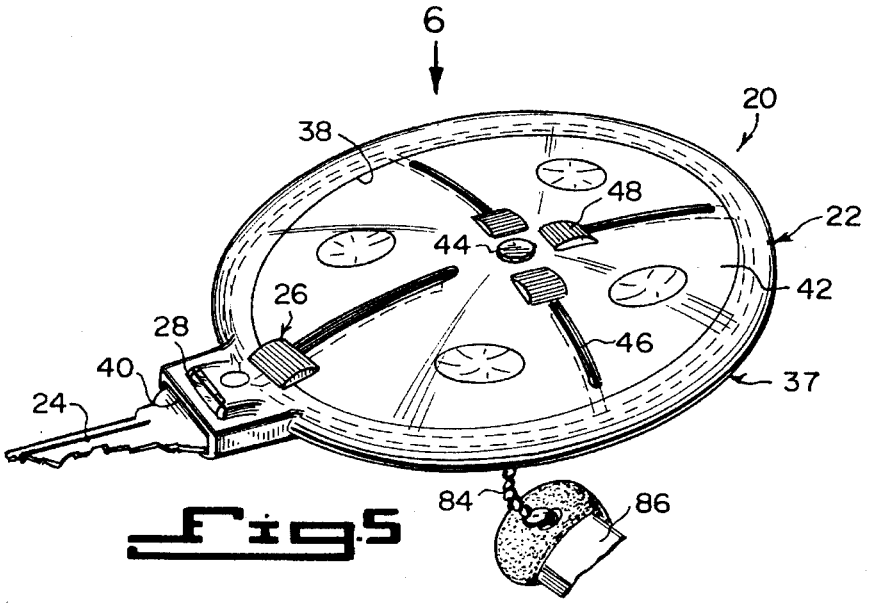
FIG. 5 is a top perspective view of a second embodiment of the instant invention.
Figure 6:
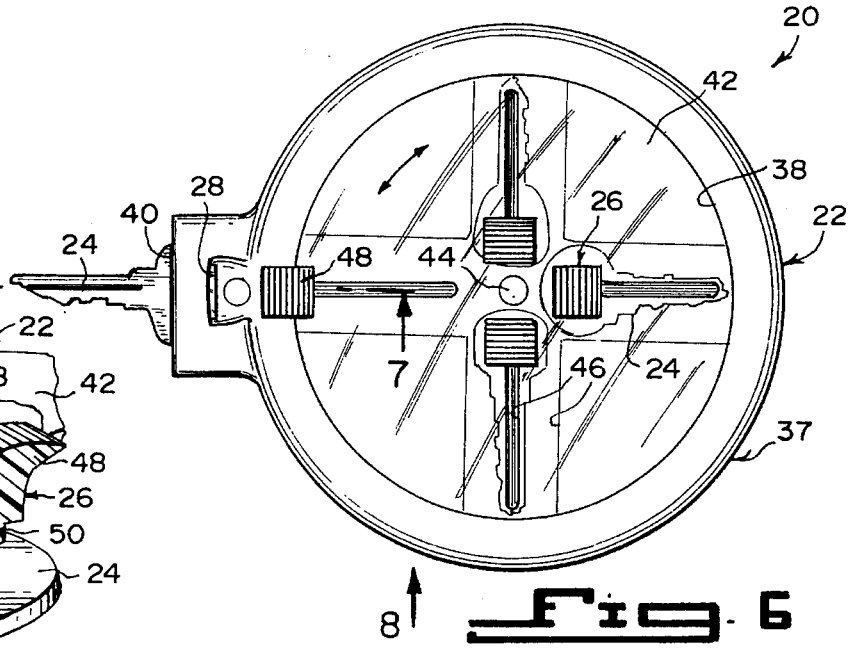
FIG. 6 is a top view taken in the direction of arrow 6 in FIG. 5.
Figure 7:
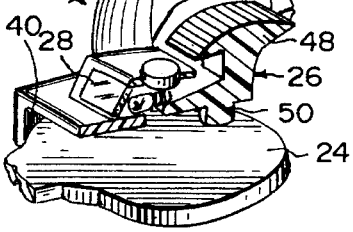
FIG. 7 is a top cross sectional perspective view taken along line 7—7 in FIG. 6.
Figure 8:
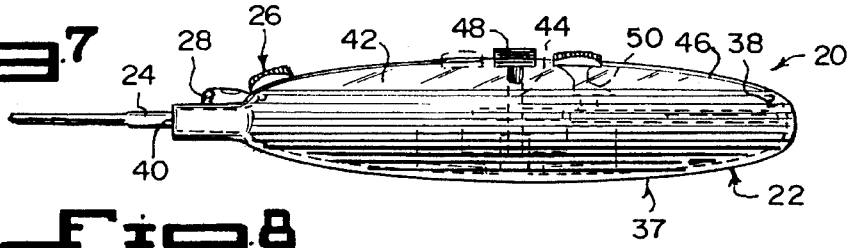
FIG. 8 is a side view taken in the direction of arrow 8 in FIG. 6.

Turning now descriptively to the drawings, in which similar reference characters denote similar elements throughout the several views, FIGS. 1 through 17 illustrate an improved key holder case with easy access feature 20, which consists of a housing 22 for carrying at least one key 24 therein. A structure 26 is for easy accessing at least one key 24 from the housing 22, so that at least one key 24 will extend out from the housing 22, to allow a person to utilize at least one key 24 in a lock.

At least one illuminating device 28 can be built therein, so that at least one illuminating device 28 when activated will illuminate at least one key 24 when extending out from the housing 22, allowing at least one key 24 to be used at night and in dimly lit areas. A clip 30 can be mounted thereto, so that the clip 30 in a first instance, is attached to a belt and in a second instance worn on a garment.

The easy accessing structure 26 in FIGS. 1 through 4A is a first embodiment and includes the housing 22 being an oblong shaped member 31, having at least one elongated slide track 32 longitudinally placed therein and at least one end exit port 34. At least one slide button 35 rides within at least one elongated slide track 32. At least one clamp assembly 36 is for connecting at least one slide button 35 to at least one key 24. At least one slide button 35 can go from a retracted position, in which at least one key 24 is withdrawn into at least one elongated slide track 32 in the housing 22, to an extended position in which at least one key 24 will extend out from at least one end exit port 34 in the housing 22.

The easy accessing structure 26 in FIGS. 5 through 8 is a second embodiment and consists of the housing 22 being a circular shaped member 37, having a large circular top opening 38 therein and a side exit port 40. A large circular cover 42 fits into the large circular top opening 38, to pivot thereabout at 44 and has at least one elongated slide track 46 radially placed therein. At least one slide button 48 rides within at least one elongated slide track 46. At least one clamp assembly 50 is for connecting at least one slide button 48 to at least one key 24. When the large circular cover 42 is pivoted to align at least one elongated side track 46 to the side exit port 40, at least one slide button 48 can go from a retracted position in which at least one key 24 is withdrawn into at least one elongated slide track 46 in the housing 22 to an extended position, in which at least one key 24 will extend out from the side exit port 40 in the housing 22.

The easy accessing structure 26 in FIGS. 9 through 15 is a third embodiment and includes the housing 22 being a rectangular shaped member 52, having an end opening 54 therein. A reversible cap 56 fits into the end opening 54 in the housing 22. A clamp assembly 58 is for connecting the reversible cap 56 to the key 24. In a first instance, the cap 56 can be plugged into the end opening 54, with the key 24 extending into the housing 22. In a second instance, the cap 56 can be reversed and plugged into the end opening 54, with the key 24 extending out from the housing 22.

Figures 9, 10, 11, 12, 13, 14, 15:
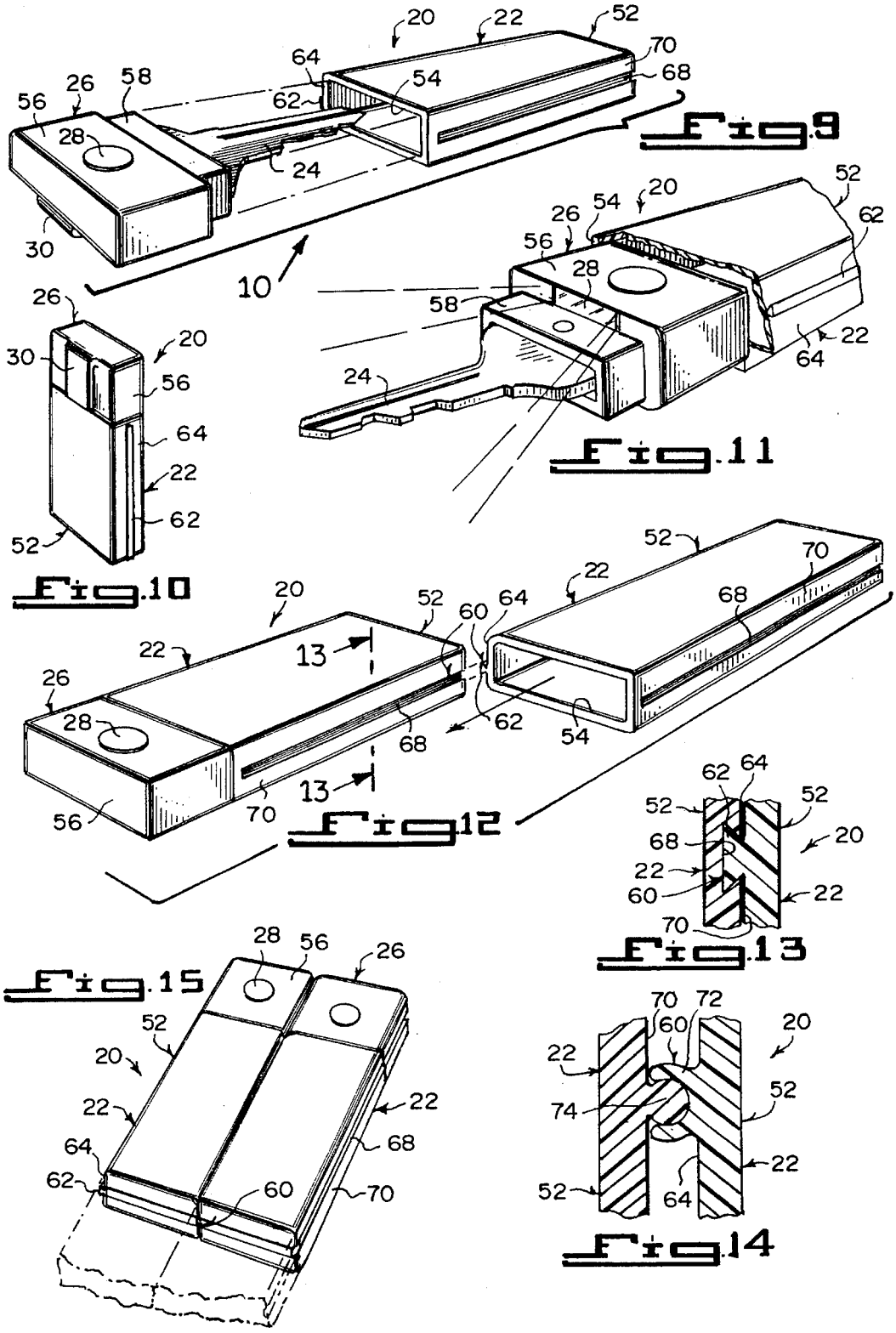
FIG. 9 is an exploded top perspective view of a third embodiment of the instant invention.
FIG. 10 is a bottom perspective view taken in the direction of arrow 10 in FIG. 9.
FIG. 11 is a top perspective view showing the key cap reversed and inserted into the housing which is broken away.
FIG. 12 is a top perspective view showing a second housing ready to be attached thereto.
FIG. 13 is an enlarged cross sectional view taken along line 13—13 in FIG. 12, after the second housing is attached thereto, showing the tongue and groove attachment structure in greater detail.
FIG. 14 is an enlarged cross sectional view similar to FIG. 13, showing another type of attachment structure in greater detail.
FIG. 15 is a top perspective view showing multiple attachments of the third embodiment together.

An assembly 60 is for removably attaching a plurality of the housings 22 together in side by side relationships, as shown in FIGS. 12 and 15.

The removably attaching assembly 60, as best seen in FIG. 13, consists of each housing 22 having an elongated tongue 62 formed longitudinally along a first side 64. An elongated groove 68 is formed longitudinally along a second opposite side 70. One tongue 62 from one housing 22 can mate with one groove 68 from another housing 22.

The removably attaching assembly 60, as shown in FIG. 14 can also include each housing 22 having an elongated socket member 72, formed longitudinally along a first side 64 and an elongated beading 74 formed longitudinally along a second opposite side 70. One beading 74 from one housing 22 can mate with one socket member 72 from another housing 22.

Figure 16:
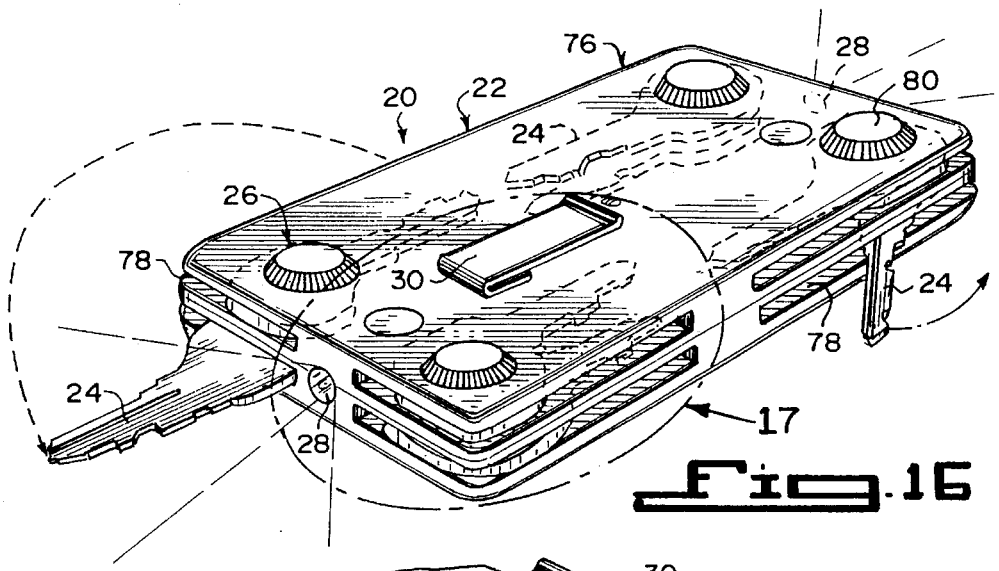
FIG. 16 is a bottom perspective view of a fourth embodiment of the instant invention.
Figure 17:
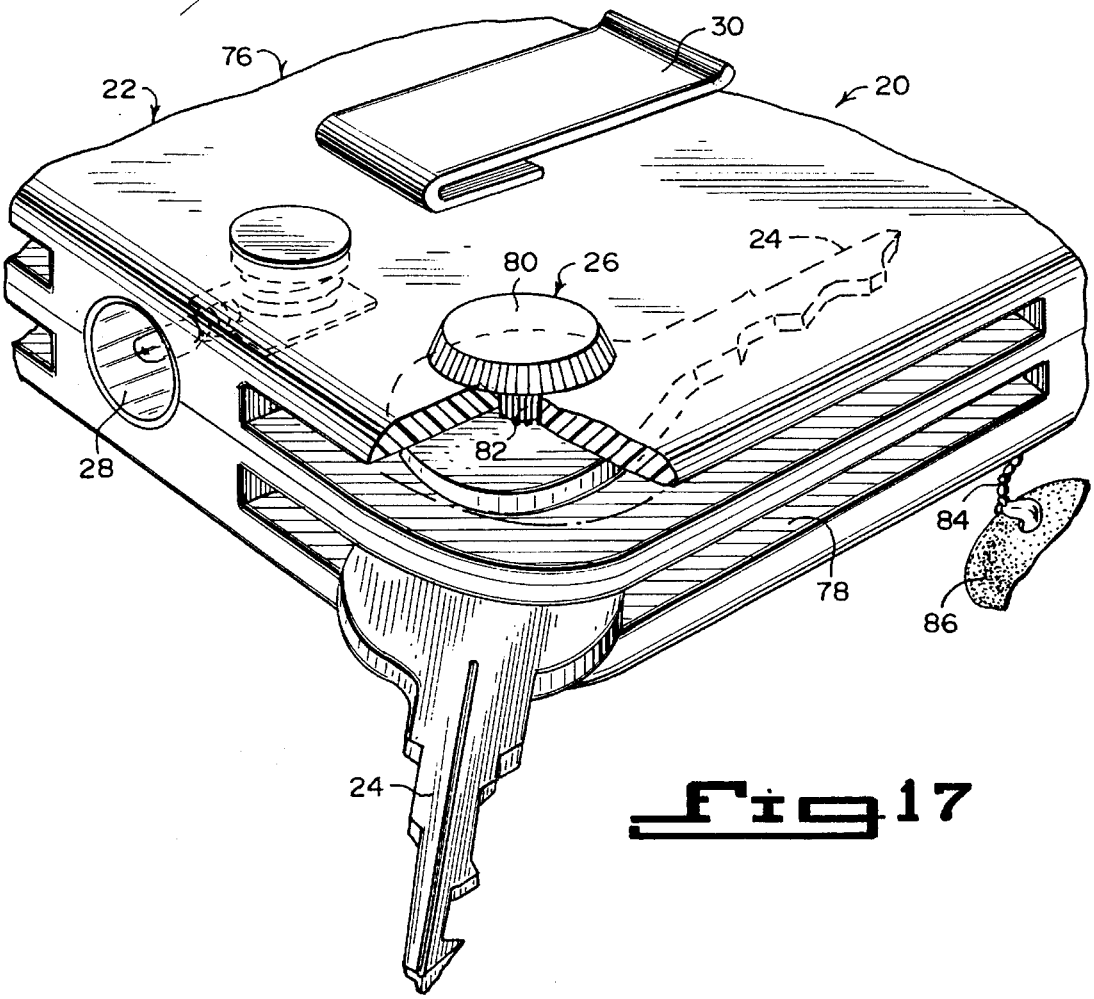
FIG. 17 is an enlarged bottom perspective view of a portion thereof as indicated by arrow 17 in FIG. 16.

The easy accessing structure 26 in FIGS. 16 and 17, shows the housing 22 being a thin rectangular shaped member 76, having at least one side corner slot 78 therein. At least one control knob. 80 is provided. At least one splined shaft 82 connects through the housing 22, at least one control knob 80 to at least one key 24 within at least one side corner slot 78. When at least one control knob 80 is turned in one direction, at least one key 24 is withdrawn into at least one side corner slot 78 in the housing 22. When at least one control knob 80 is turned in an opposite direction, at least one key 24 will extend out from at least one side corner slot 78 in the housing 22.

A key chain attachment unit 84 can also be connected to the housing 22, so that an additional key 86, such as a car key can be connected thereto for immediate use.

The housing 22, as shown in FIGS. 1 and 3 can further include a cover 88, formed from a top portion thereof. A hinge 90 is between one side of the cover 88 and the housing 22. The cover 88 can swing into an open position, to allow at least one key 24 to be removed and replaced when needed. A latch mechanism 92 is between an opposite side of the cover 88 and the housing 22, so as to retain the cover 88 in a closed working position.

LIST OF REFERENCE NUMBERS

20 improved key holder case with easy access feature
22 housing
24 key
26 easy accessing structure for 24
28 illuminating device
30 clip
31 oblong shape member for 22
32 elongated slide track in 31
34 end exit port in 31
35 slide button in 32
36 clamp assembly between 35 and 24
37 circular shaped member for 22
38 large circular top opening in 37
40 side exit port in 37
42 large circular cover in 38
44 pivot on 42
46 elongated slide track in 42
48 slide button in 46
50 clamp assembly between 48 and 24
52 rectangular shaped member for 22
54 end opening in 52
56 reversible cap
58 clamp assembly between 56 and 24
60 removably attaching assembly
62 elongated tongue on 64
64 first side of 22
68 elongated groove on 70
70 second side of 22
72 elongated socket member on 64
74 elongated beading on 70
76 thin rectangular shaped member for 22
78 side corner slot in 76
80 control knob
82 splined shaft on 80
84 key chain attachment unit on 22
86 additional key on 84
88 cover of 22
90 hinge between 88 and 22
92 latch mechanism on 88 and 22

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved key holder case with easy access feature which comprises:

a) a housing for carrying at least one key therein;

b) means for easy accessing at least one key from said housing, so that at least one key will extend out from said housing, to allow a person to utilize at least one key in a lock, circular shaped member, having a large circular top opening therein and a side exit port, a large circular cover which fits into said large circular top opening, to pivot thereabout and having at least one elongated slide track radially placed therein, at least one slide button to ride within said at least one elongated slide track, and at least one clamp assembly for connecting said at least one slide button to at least one key, so that when said large circular cover is pivoted to align said at least one elongated slide track to said side exit port, said at least one slide button can go from a retracted position, in which at least one key is withdrawn into said at least one elongated slide track in said housing to an extended position, in which at least one key will extend out from said side exit port in said housing;

c) at least one illuminating device built therein, so that said at least one illuminating device when activated will illuminate at least one key when extending out from said housing, allowing at least one key to be used at night and in dimly lit areas;

d) a clip mounted thereto, so that said clip is in a first instance attached to a belt and in a second instance worn on a garment.

2. An improved key holder case with easy access feature which comprises:

a housing for carrying at least one key therein; and means for easy accessing at least one key from said housing, so that at least one key will extend out from said housing, to allow a person to utilize at least one key in a lock, further including at least one illuminating device built therein, so that said at least one illuminating device when activated will illuminate at least one key when extending out from said housing, allowing at least one key to be used at night and in dimly lit areas, further including a clip mounted thereto, so that said clip is in a first instance attached to a belt and in a second instance worn on a garment, wherein said easy accessing means includes:

a) said housing being a rectangular shaped member, having an end opening therein;

b) a reversible cap which fits into said end opening in said housing; and c) a clamp assembly for connecting said reversible cap to the key, so that in a first instance, said cap can be plugged into said end opening with the key extending into said housing and in a second instance, said cap can be reversed and plugged into said end opening with the key extending out from said housing.

3. An improved key holder case with easy access feature as recited in claim 2, further including means for removably attaching a plurality of said housings together in side by side relationships.

4. An improved key holder case with easy access feature as recited in claim 3, wherein said removably attaching means includes each said housing having an elongated tongue formed longitudinally along a first side and an elongated groove formed longitudinally along a second opposite side, so that one said tongue from one said housing can mate with one said groove from another said housing.

5. An improved key holder case with easy access feature as recited in claim 3, wherein said removably attaching means includes each said housing having an elongated socket member formed longitudinally along a first side and an elongated beading formed longitudinally along a second opposite side, so that one said beading from one said housing can mate with one said socket member from another said housing.

* * * * *